United States Patent [19]

Gordon

[11] 4,030,656

[45] June 21, 1977

[54] STAPLER

[75] Inventor: Stanley H. Gordon, Concord, Mass.

[73] Assignee: Acme Staple Company, Inc., Franklin, N.H.

[22] Filed: Aug. 9, 1976

[21] Appl. No.: 712,689

[52] U.S. Cl. ..... 227/131; 361/166

[51] Int. Cl.[2] ..... B27F 7/22

[58] Field of Search ..... 227/131; 317/137, 139, 317/151

[56] References Cited

UNITED STATES PATENTS

| | | | |
|---|---|---|---|
| 2,580,135 | 12/1951 | Soave | 227/131 |
| 2,635,235 | 4/1953 | Green | 227/131 |
| 2,883,666 | 4/1959 | Moore | 227/131 |
| 2,981,869 | 4/1961 | Balint | 317/137 |
| 3,219,854 | 11/1965 | McLaughlin | 317/139 |

*Primary Examiner*—Granville Y. Custer, Jr.

[57] ABSTRACT

An electromagnetic power device for moving the operating rod of a stapler or the like having a driving head pivotally mounted on a support member for movement toward an anvil, including plunger means mounted on the support member for linear movement through an advancing stroke from a first inoperative position to a second position for advancing the head and through a driving stroke from the second position toward a third position for driving the staple. Advancing coil means are provided for moving the plunger means from the first position to the second position and driving coil means are provided for moving the plunger means from the second position toward the third position. Circuit means are provided including a foot switch having sequentially operable switch means, the switch means having a normal switch position and sequentially operable advancing and driving switch positions for energizing first the advancing coil and thereafter the driving coil.

16 Claims, 5 Drawing Figures

FIG 3
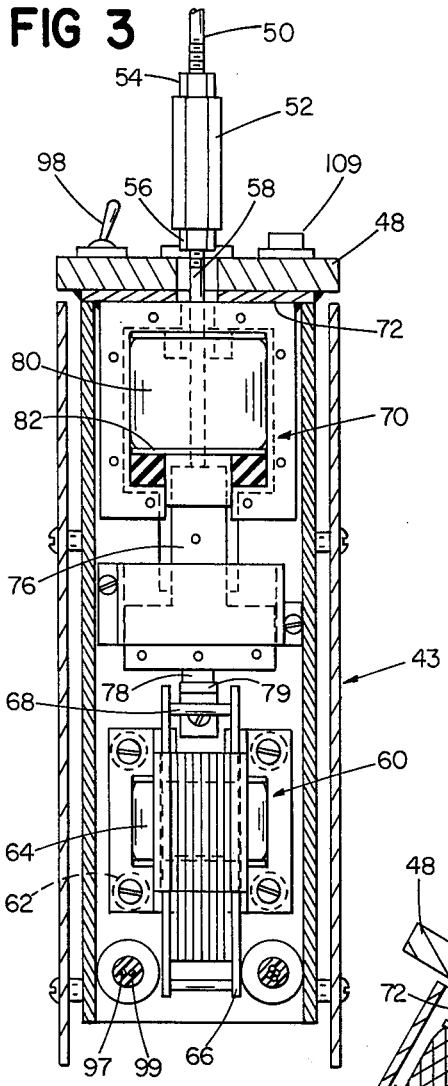
FIG 5
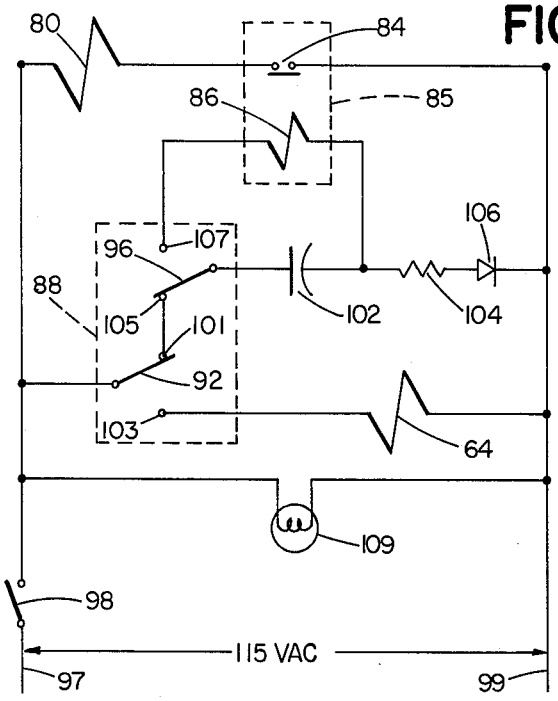
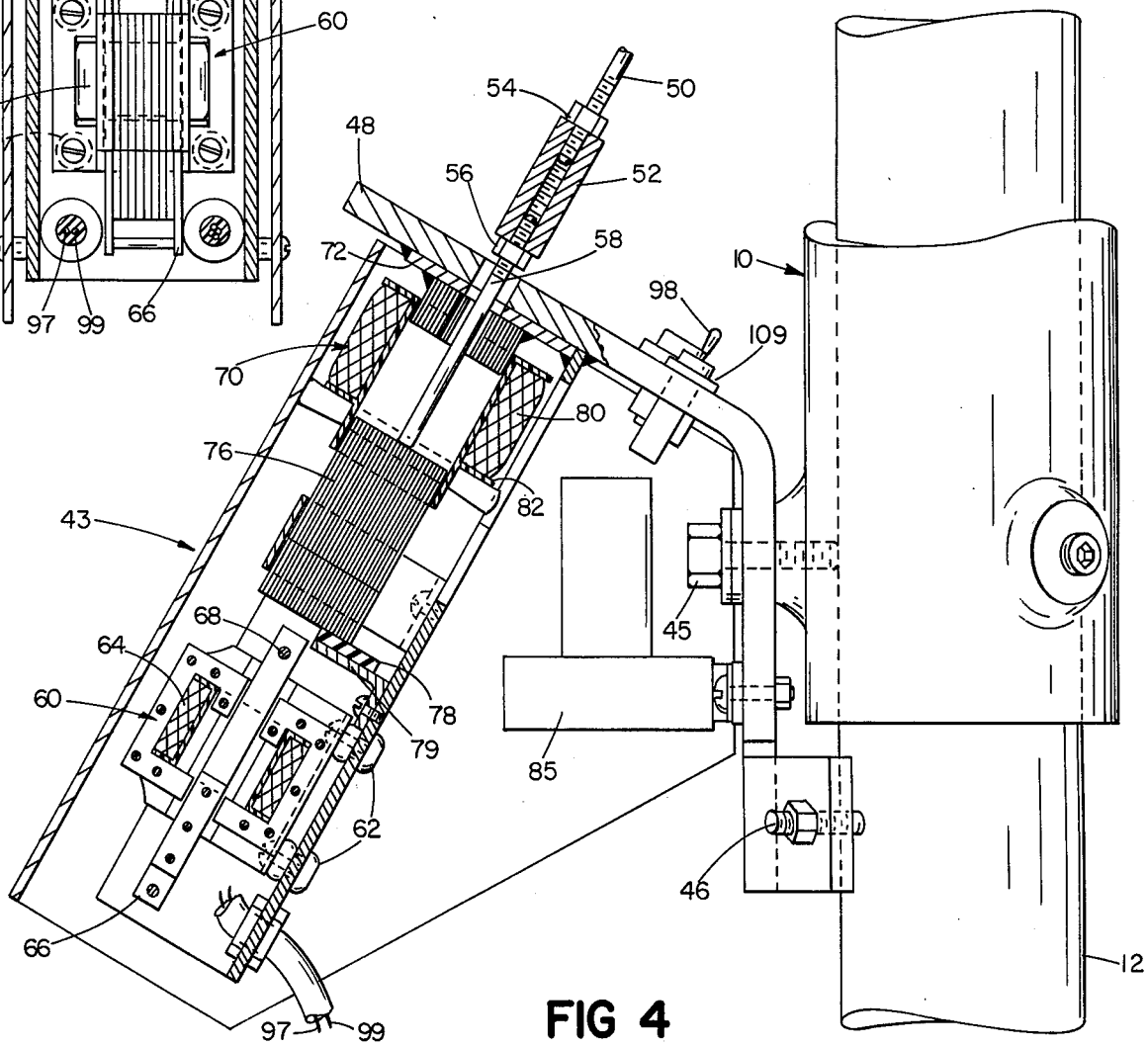
FIG 4

STAPLER

FIELD OF THE INVENTION

This invention relates to electromagnetic power devices, and more particularly, to a low cost power device especially adapted for stapling machines and the like.

BACKGROUND OF THE INVENTION

Small businesses in mail order, graphic arts, light manufacturing, etc. require stapling of materials up to ½-inch thickness. Hand or foot powered machines are in general use, but these are tedious and slow. Hand operation requires efforts which, after a few hours, are exhausting to many operators, while foot operation requires standing on one foot or the other for long hours while operating a relatively high foot pedal having a relatively long travel distance.

An electric machine is much needed, but existing machines which are in the price range of such businesses are, in the present state of the art, relatively small in size, and are limited to stapling relatively thin materials, due to the small size of the solenoid generally used in low price machines. Since larger solenoids are very expensive, efforts have been made to increase the thickness of work that such small solenoid machines can handle by using very thin staple wire. These thin staples however, are too weak to hold, in many applications, such as book binding, for example.

In addition, adjustment of such machines to various work thicknesses is not generally provided, with the result that the head height clearance may be marginal when used with the maximum thickness that the machine can handle, and this increases the difficulty of getting work into the machine for stapling.

Making such a machine with a solenoid having the size and stroke and force needed to handle ½-inch work thicknesses with heavy wire sizes of staples would, in the present state of the art, drastically increase the cost of the machine, due to the much higher cost of the large, long stroke solenoid needed for this work. The price range would then compare with the cost of staple driving machines employing a motor, flywheel and electric clutch combination, which are common in the shoe and belting industry, and which are ordinarily too expensive for general use in schools, small print shops, etc.

Another problem with existing electrically powered staple driving machines results from the fact that in stapling work, the stapling head must be raised a clearance distance above the work to facilitate work flow. Often this distance is enough so that an operator's hand or finger can pass under the stapling head. In existing electrically operated machines of either the solenoid or motor powered type, the power stroke is used to bring the stapling head down to the work as the staple is driven, and thus the power stroke is a constant danger to the operator. As a result, most power staplers are used with various finger guards, which tend to slow the work flow, and cause inaccurate staple placement. Furthermore, operators tend to remove such guards and are then exposed to the danger mentioned.

In an effort to alleviate this problem, some solenoid operated machines have been made in which a foot pedal is used to bring the head down onto the work manually, and then further foot pedal pressure operates the solenoid to drive the staple electrically. This type of machine is safer to operate, but it requires almost the same operator effort as a manual machine, since the operator must essentially stand on one foot while operating it, often for many hours.

SUMMARY OF THE INVENTION

Accordingly, it is an object of this invention to provide a power unit attachable to existing manually operated foot pedal type staplers, to convert these machines to electric operation, thereby saving small businesses the cost of buying an entirely new machine.

It is also an object to provide an entirely new machine, having a power unit for electric operation.

A further object is to provide a machine which will be relatively inexpensive, yet will handle heavier work than present electric machines in its price range can handle, as required by small volume operators.

Another object is to provide a machine with bi-level force operation, so that first the stapling head can be brought down on the work with a light force, and than as the operator desires, staples can be driven with a much greater force, thereby to reduce the hazard to the operator during the time when fingers could be under the stapling head.

It is also an object to provide a two-stage foot switch, each stage of which controls a separate solenoid, whereby the operator can operate one stage to push the head down onto the work, and then operate a second stage to drive the staple.

It is a further object to provide a relatively flat foot switch control having two stages so that operator fatigue is reduced, and standing on one foot during operation is eliminated.

Another object is to provide means in a solenoid operated stapler whereby an adjustment can be made for work thickness, thereby using the drive stroke of the solenoid at its most efficient stroke position, which permits the use of a relatively short stroke and a relatively low cost solenoid to drive the staple.

In addition, it is an object to make possible low solenoid costs in a power unit for stapler or the like, by the use of fewer than normal wire winding turns on the coil, thereby increasing the force of the coil to approximate the force of a larger solenoid.

It is another object to avoid excess heat that would result from operation of a solenoid coil having fewer than normal winding turns, by the use of a circuit which limits the "on" time of the coil to approximately seven electrical cycles for each operation of the foot switch.

Another object is to prevent "machine gun" operation of the stapler by a circuit which operates the staple driving solenoid once only, for any period of time in which a contact in the foot switch is held in the closed position.

A further object is to provide a power unit in which two solenoids are used, whereby forces of different magnitude can be obtained and correlated to different functions of the unit, such as the head closing function and the staple driving functions.

In addition, it is an object to provide a power unit which can be mounted on an existing stapler pedestal at an angle such that operation of the stapling lever can be accomplished in a direct, straight line, thereby, avoiding side loads on the solenoid bearing.

These objects of the invention are accomplished by providing an electromagnetic power device comprising plunger means linearly movable through an advancing stroke from a first inoperative position to a second position and through a driving stroke from the second position toward a third position, advancing coil means for moving the plunger means from the first position to the second position, driving coil means for moving the plunger means from the second position toward the third position and circuit means including sequentially operable switch means for energizing first the advancing coil means and thereafter the driving coil means to move the plunger means first through the advancing stroke and thereafter through the driving stroke. The circuit means may include single pulse generating means for energizing the driving coil means and the sequentially operable switch means may include a normal switch position and sequentially operable advancing and driving switch positions for energizing first the advancing coil and thereafter the driving coil, the switch means only in the driving switch position operating the single pulse generating means to generate a single pulse and only in the normal switch position operating to reset the single pulse generating means.

In more limited aspects, the present invention provides, in a stapler or the like having a driving head pivotally mounted on a support member for movement toward an anvil and an operating rod pivotally mounted on the driving head and extending therefrom adjacent the support member for moving the driving head, an electromagnetic power device for moving the operating rod. Such device includes plunger means mounted on the support member for linear movement through an advancing stroke from a first inoperative position to a second position and through a driving stroke from the second position toward a third position, the plunger means being coaxial with the operating rod and being adjustably connected thereto.

Advancing coil means are provided for moving the plunger means from the first position to said second position and driving coil means are provided for moving the plunger means from the second position toward the third position, the advancing coil means being effective to move the plunger means through a greater stroke than the driving coil means and the driving coil means being effective to move the plunger with greater force than the advancing coil means. The circuit means provided includes single pulse generating means preferably having capacitor means for energizing the driving coil means and a foot switch including a base and sequentially operable switch means mounted on the base, the switch means having a normal switch position and sequentially operable advancing and driving switch positions for energizing first the advancing coil and thereafter the driving coil. An operating plate is mounted on the base for sequentially operating the switch means and spring means are interposed between the base and the operating plate effective to provide greater opposing force to movement of the plate to the driving switch position than to movement of the plate to the advancing switch position. The switch means only in the driving switch position operates to discharge the capacitor means to generate the single pulse and only in the normal switch position operates to reset the single pulse generating means to charge the capacitor means.

BRIEF DESCRIPTION OF THE DRAWINGS

Other objects and features of this invention will be apparent from the following detailed description of a preferred embodiment thereof, taken with the accompanying drawings, in which:

FIG. 3 is a partly cut away rear view of the electromagnetic power device of FIG. 1 taken on lines 3—3 thereof, shown in its inoperative position;

FIG. 4 is a partly cut away side view of the device of FIG. 3; and

FIG. 5 is a circuit diagram of the device of FIGS. 1, 3 and 4.

DETAILED DESCRIPTION

Figure 1:
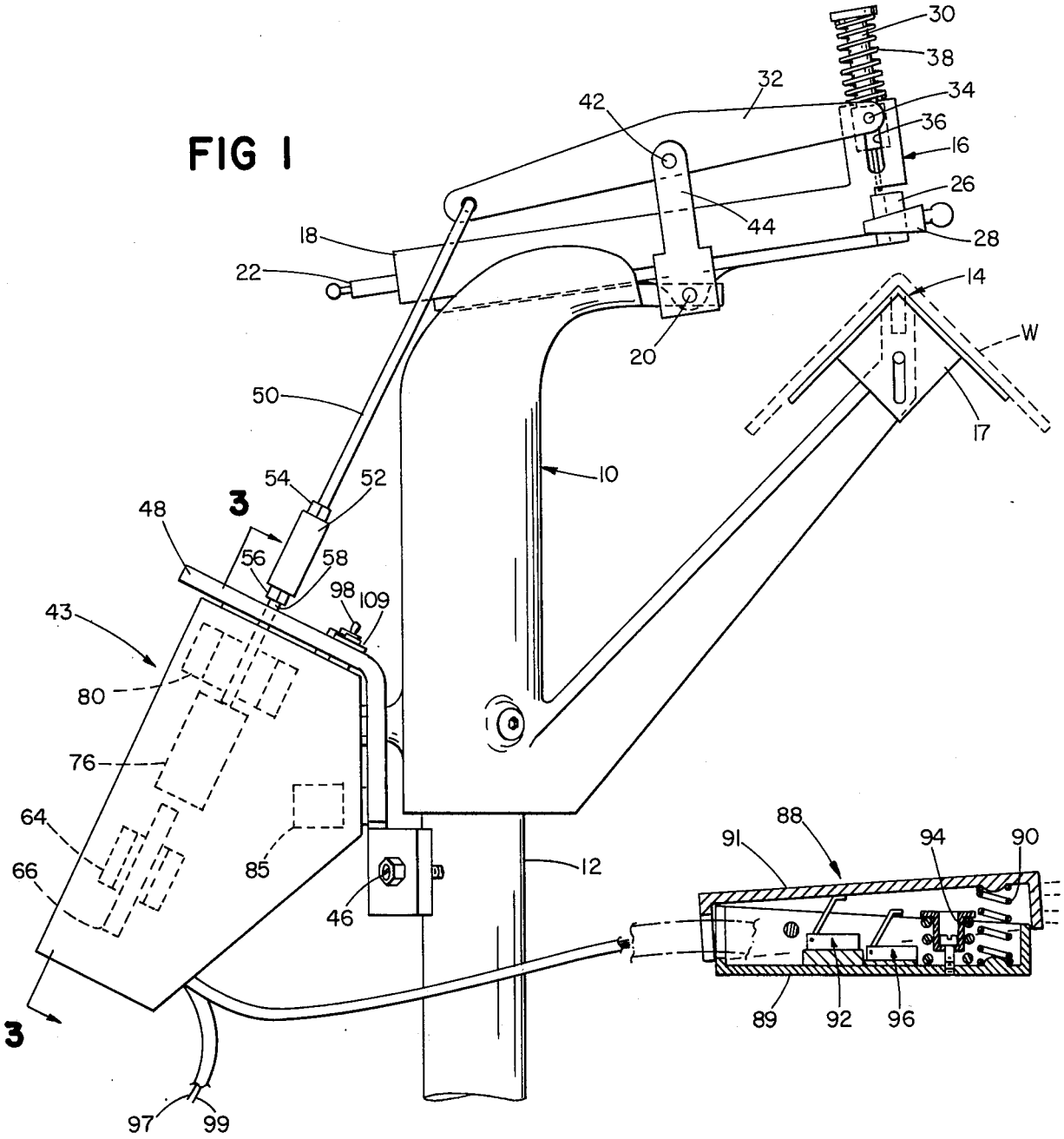
FIG. 1 is a side elevation, partly in section, the view showing a stapler with its head in its normal or rest position, with the electromagnetic power device of the invention attached to the stapler pedestal.

Referring to the drawings, in FIG. 1 is shown a typical floor mounted stapler. The support member 10 is mounted on a post 12 which is in turn mounted in a base (not shown) resting on the floor. The stapler support member 10 supports an anvil 14 under the driving head 16 which is pivotally mounted on member 10 for movement toward anvil 14, said head normally being raised above the anvil 14 by gravity, as shown in FIG. 1. A saddle 17 is used to locate work W for stapling the backs of booklets, etc, and which is adjustable to horizontal for horizontal work.

Figure 2:
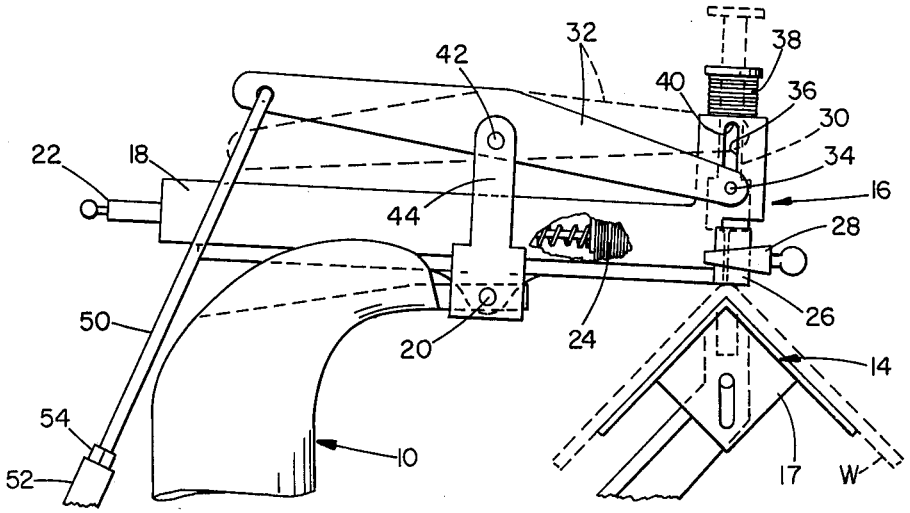
FIG. 2 is a partial view similar to FIG. 1, illustrating the movement of the stapler head from the rest position to the full stroke position.

Driving head 16 includes an elongated staple magazine 18, said magazine being pivotally mounted to stapler support member 10 by pin 20. A pusher assembly 22 is provided which can be removed to load magazine 18 with sticks of staples 24 (FIG. 2), and when installed, serves to spring load the staples 24 against the end cap 26, as required for proper feeding. End cap 26 is secured by a clamp 28. The staple driver assembly 30 travels axially within a bore (not shown) in driving head 16, and is pivotally attached to drive lever 32 by pin 34. Pin 34 travels in slot 36. Return spring 38 spring loads driver assembly 30 so that pin 34 is held against an end 40 of slot 36 (FIG. 2) when no opposing force acts on drive lever 32. Drive lever 32 is pivoted on pin 42 which is carried by link 44, pivoted on pin 20, so that pin 34 is free to travel with driver assembly 30 in a straight line, as shown in FIG. 2, when drive lever 32 operates. Driving head 16 in its rest position is tilted up away from anvil 14 by gravity, as shown in FIG. 1. An operating rod 50 is pivotally mounted on driving head 16 and extends therefrom adjacent support member 10 for moving driving head 16.

The stapler as thus far described is entirely conventional and has been widely used.

The present invention provides a novel electromagnetic power device, generally designated 43, for moving operating rod 50 and driving head 16, said device 43 being attached to stapler support member 10 by a single bolt 45 (FIG. 4). Adjusting screws 46 (only one is shown) can be tightened to adjust the angle of mounting bracket 48 both from side to side and in the horizontal to vertical direction.

The operating rod 50 extends from stapler drive lever 32, and is threaded to a coupling nut 52 which is secured by lock nuts 54 and 56. A solenoid plunger push rod 58 coaxial therewith is threadedly received by the coupling nut 52. Adjustment of coupling nut 52 lengthens or shortens the effective length of operating rod 50, which tilts the driving head 16 toward or away from anvil 14, to adjust the amount of work clearance required for various work thicknesses.

The solenoid plunger push rod 58 is thus mounted on support member 10 for linear movement through an advancing stroke from a first inoperative position to a second position and through a driving stroke from said second position toward a third position.

Referring to FIGS. 3 and 4, electromagnetic power device 43 has an advancing solenoid 60, shock mounted on elastomer members 62, to avoid shock damage to its advancing coil 64. Solenoid 60 includes a plunger 66 which extends through coil 64. Plunger 66 is movable in an axial direction, and normally drops by gravity to the position shown in FIGS. 3 and 4. It is retained in solenoid 60 by pin 68.

Electromagnetic power device 43 also includes a driving solenoid 70 having a base 72 welded to bracket 48. Solenoid plunger push rod 58 is connected to operating rod 50 by an adjustable coupling nut 52. Plunger 76 bears against push rod 58 but is not attached to it. Plunger 76 is normally positioned by gravity against an elastomer stop 78, carried by bracket 79, which limits the downward travel of said plunger, and plunger 76 is spaced apart from plunger 66 unless solenoid 60 is energized, as will be described. Driving solenoid 70 includes a driving coil 80 which is wound on bobbin 82. Coil 80 is wound with fewer turns of wire than would be standard practice for an intermittent duty coil. For example, one manufacturer used 345 turns of No. 19 wire for an intermittent duty coil, and at 115 VAC and at a 1-inch plunger extension, a force of 30 lbs. is produced. The closing force of such solenoid is 50 lbs. Driving coil 80, as described herein, and using the above described manufacturer's solenoid and bobbin, is wound with 195 turns of No. 17 wire, and at 115 VAC and at a 1-inch plunger extension, a force of 54 lbs. is produced. The closing force of the solenoid with coil 80 as described, is 125 lbs.

It is a particular feature of the invention that the advancing solenoid 60 and its coil 64 is effective to move plunger push rod 58 and operating rod 50 from the first, inoperative position to the second position through a greater stroke than the driving solenoid 70 and its coil 80 and that the driving solenoid 70 and its coil 80 is effective to move plunger push rod 58 and operating rod 50 from the second position toward the third position with greater force than advancing solenoid 60 and its coil 64.

As best shown in FIG. 1, a two-stage foot switch, generally designated 88, is provided for operating the electromagnetic power device 43 of the invention. Switch 88 includes a base 89 having mounted herein sequentially operable single pole double throw switches 92 and 96 mounted on base 89, said switches having a normal switch position and sequentially operable advancing and driving switch positions for energizing first advancing coil 64 to move rods 50 and 58 from their first position to their second position and thereafter driving coil 80 to move them from their second position toward their third position. Foot switch operating plate 91 is pivotally mounted on base 89 for sequentially operating switches 92 and 96. Springs 90 and 94 are interposed between base 89 and operating plate 91 and are effective to provide greater opposing force to movement of plate 91 to the driving switch position than to movement to the advancing switch position. Thus, light foot pressure overcomes spring 90 and operates switch 92. Heavier foot pressure will overcome spring 94, to operate switch 96. Release of foot pressure allows both switches 92 and 96 to open.

The operating circuit for the electromagnetic power device 43 of the invention is shown in FIG. 5. Referring to that Figure, the circuit elements are connected between 115 VAC lines 97 and 99, line 97 having in series therewith a power switch 98 mounted on bracket 48. An indicator lamp 109 is connected to be illuminated when switch 98 is closed, to indicate that the circuit is in operation.

Driving solenoid coil 80 is connected between lines 97 and 99 in series with the normally open contacts 84 of relay 85. Switches 92 and 96 are shown in their "normal" position connected in series with their normally closed terminals 101 and 105, respectively, and in series with capacitor 102, diode 106 and its current limiting resistor 104, all between lines 97 and 99. In such "normal" switch position, capacitor 102 will become charged through resistor 104 and diode 106. The coil 86 of relay 85 is connected to normally open terminal 107 of driving switch 96 across capacitor 102. The advancing coil 64 is connected in series with normally open terminal 103 of advancing switch 92.

In operation, the power lines 97 and 99 are connected to a 115 VAC supply, and power switch 98 is turned "on". This charges capacitor 102. Indicator lamp 109 also is illuminated.

The magazine 18 is loaded with staples of the correct length for the work to be done, and the work is placed on the anvil 14. The first stage of the foot switch 88 is depressed, connecting advancing switch 92 to its normally open terminal 103 and energizing advancing solenoid coil 64. When terminal 101 of advancing switch 92 is closed to energize advancing coil 64, capacitor 102 is disconnected from the charging current, but it remains charged. Advancing solenoid 60 will remain "on" as long as foot switch 88 is depressed. When energized, advancing solenoid 60 causes rods 50 and 58 to make a linear advancing stroke from a first inoperative position to a second position. During this stroke, plunger 66 raises plunger 76 into driving solenoid coil 80, bringing plunger 76 into the working range of the magnetic field of coil 80, which is "off". At the same time, plunger 76 acts on push rod 58, which acts on operating rod 50 to move lever 32 and thereby bring the stapling head 16 down on the work. Coupling nut 52 can now be adjusted so that end cap 26 touches the work lightly, and lock nut 54 should then be tightened. This advancing stroke to the second position of rods 50 and 58 thus accomplishes four results:

1. It brings driving head 16 down on the work W. This must occur, since "head clearance" must exist in order to insert and remove work rapidly. Electric staplers have been made where head clearance is taken up by a manual foot pedal, which operates the solenoid after the head is stopped by coming against the work, but such an arrangement is nearly as much effort as that required with a straight mechanical unit.

2. In bringing down the head, the force is very light, far less than is needed to drive a staple. It will not injure the operator's hand. Heretofore known electric staplers use a heavy, single solenoid to both bring down the head and drive the staple, in one power stroke. This not only means that head clearance is reduced to a minimum (since long stroke solenoids are costly), but also that it is dangerous to an operator's hand and should be fitted with a guard, which slows down the operation.

3. Adjustment of coupling nut 52 to provide the right stroke position for a particular work thickness is done while the advancing solenoid 60 is held "on" continuously, holding the driving head 16 down until coupling nut 52 is turned so that the head rests just touching the work, since constant current can be maintained by the first stage. This adjustment feature gives the greatest work capability for the smallest, cheapest solenoid.

4. Operation of the advancing solenoid 60 puts the plunger 76 of driving solenoid 70 into its coil field where it can be operated. The fact that it cannot be operated until it is adjacent its coil field is a safety feature, preventing a power stroke during head advancing movement.

After the advancing stroke is completed, in order to drive a staple, the foot switch 88 should be operated through both foot switch stages, connecting both switches 92 and 96 to their normally open contacts 103 and 107. Operation of the second stage connects terminal 107 of switch 96 to relay coil 86, so that the discharge current from capacitor 102, acting as a single pulse generator, passes through the coil 86 of relay 85 and closes its contacts 84 to connect driving solenoid coil 80 to 115 VAC lines 97 and 99. The inductance of the said coil 86 is just sufficient to retard the current so that with a 20 mf capacitor 102, relay contacts 84 will be closed for about seven electrical cycles. When driving solenoid coil 80 receives the seven cycles of current, it moves rods 50 and 58 from the second position toward a third position, driving the staple. Actual closing time is one full cycle, with a current drain of 60 amps, and while closed, the six additional cycles are at lesser amperage, about 20 amps being an average value, due to the presence of the plunger 76 in the coil 80 field. The power relay 85 can, therefore, make 60 amps, but only has to break 20 amps, reducing relay costs.

It is a particular feature of the invention that the foot switch 88 only in its driving switch position operates to discharge capacitor 102 to generate its single pulse and only in its normal switch position operates to reset charge capacitor 102. Thus, the second stage of foot switch 88, even if it could be closed without the first stage being operated, would not cause driving solenoid 70 to operate, since driving solenoid 70 is inoperative until advancing solenoid 60 raises plunger 76 up to within reach of the magnetic field of driving solenoid coil 80.

After coil 86 of relay 85 has received the single current pulse from capacitor 102, its contacts 84 open immediately, whether foot switch 88 has been released or not, and relay contacts 84 cannot be closed again until another pulse is received from capacitor 102. The capacitor 102 thus cannot be charged again until foot switch 88 is fully released with contacts 101 and 105 in their normal positions. This prevents "machine gun" operation of the stapler, since a complete foot switch operation is required for each staple driven.

I claim:

1. An electromagnetic power device comprising plunger means linearly movable through an advancing stroke from a first inoperative position to a second position and through a driving stroke from said second position toward a third position advancing coil means for moving said plunger means from said first position to said second position driving coil means for moving said plunger means from said second position toward said third position and circuit means including sequentially operable switch means for energizing first said advancing coil means and thereafter said driving coil means to move said plunger means first through said advancing stroke and thereafter through said driving stroke.

2. An electromagnetic power device as claimed in claim 1, wherein said circuit means includes single pulse generating means for energizing said driving coil means.

3. An electromagnetic power device as claimed in claim 2, wherein said sequentially operable switch means includes a normal switch position and sequentially operable advancing and driving switch positions for energizing first said advancing coil and thereafter said driving coil, said switch means only in said driving switch position operating said single pulse generating means to generate a single pulse and only in said normal switch position operating to reset said single pulse generating means.

4. An electromagnetic power device as claimed in claim 3 wherein said single pulse generating means includes capacitor means said switch means only in said driving switch position operating to discharge said capacitor means to generate said single pulse and only in said normal switch position operating to charge said capacitor means.

5. An electromagnetic power device comprising plunger means linearly movable through an advancing stroke from a first inoperative position to a second position and through a driving stroke from said second position toward a third position advancing coil means for moving said plunger means from said first position to said second position driving coil means for moving said plunger means from said second position toward said third position said advancing coil means being effective to move said plunger means through a greater stroke than said driving coil means and said driving coil means being effective to move said plunger with greater force than said advancing coil means and circuit means including sequentially operable switch means for energizing first said advancing coil means and thereafter said driving coil means to move said plunger means first through said advancing stroke and thereafter through said driving stroke.

6. An electromagnetic power device comprising plunger means linearly movable through an advancing stroke from a first inoperative position to a second position and through a driving stroke from said second position toward a third position advancing coil means for moving said plunger means from said first position to said second position driving coil means for moving said plunger means from said second position toward said third position said advancing coil means being effective to move said plunger means through a greater stroke than said driving coil means and said driving coil means being effective to move said plunger with greater force than said advancing coil means and circuit means including single pulse generating means for energizing said driving coil means and sequentially operable switch means having a normal switch position and sequentially operable advancing and driving switch positions for energizing first said advancing coil and thereafter said driving coil, said switch means only in said driving switch position operating to generate said single pulse and only in said normal switch position operating to reset said single pulse generating means.

7. An electromagnetic power device as claimed in claim 6, wherein said single pulse generating means includes capacitor means and said switch means only in said driving switch position operates to discharge said capacitor means to generate said single pulse and only in said normal switch position operates to reset said single pulse generating means to charge said capacitor means.

8. In a stapler or the like having a driving head pivotally mounted on a support member for movement toward an anvil and an operating rod pivotally mounted on said driving head and extending therefrom adjacent said support member for moving said driving head, an electromagnetic power device for moving said operating rod comprising plunger means mounted on said support member for linear movement through an advancing stroke from a first inoperative position to a second position and through a driving stroke from said second position toward a third position advancing coil means for moving said plunger means from said first position to said second position driving coil means for moving said plunger means from said second position toward said third position and circuit means including sequentially operable switch means for energizing first said advancing coil means and thereafter said driving coil means to move said plunger means first through said advancing stroke and thereafter through said driving stroke.

9. In a stapler or the like as claimed in claim 8, wherein said plunger means is coaxial with said operating rod and is adjustably connected thereto.

10. In a stapler or the like as claimed in claim 8, wherein said advancing coil means is effective to move said plunger means through a greater stroke than said driving coil means and said driving coil means is effective to move said plunger with greater force than said advancing coil means.

11. In a stapler or the like having a driving head pivotally mounted on a support member for movement toward an anvil and an operating rod pivotally mounted on said driving head and extending therefrom adjacent said support member for moving said driving head, an electromagnetic power device for moving said operating rod comprising plunger means mounted on said support member for linear movement through an advancing stroke from a first inoperative position to a second position and through a driving stroke from said second position toward a third position advancing coil means for moving said plunger means from said first position to said second position driving coil means for moving said plunger means from said second position toward said third position and a foot switch including a base sequentially operable switch means mounted on said base, said switch means having a normal switch position and sequentially operable advancing and driving switch positions for energizing first said advancing coil and thereafter said driving coil and an operating plate mounted on said base for sequentially operating said switch means.

12. In a stapler or the like as claimed in claim 11, further including opposing means effective to provide greater opposing force to movement of said plate to said driving switch position than to movement of said plate to said advancing switch position.

13. In a stapler or the like as claimed in claim 12, wherein said opposing means is spring means interposed between said base and said operating plate.

14. In a stapler or the like having a driving head pivotally mounted on a support member for movement toward an anvil and an operating rod pivotally mounted on said driving head and extending therefrom adjacent said support member for moving said driving head, an electromagnetic power device for moving said operating rod comprising plunger means mounted on said support member for linear movement through an advancing stroke from a first inoperative position to a second position and through a driving stroke from said second position toward a third position advancing coil means for moving said plunger means from said first position to said second position driving coil means for moving said plunger means from said second position toward said third position circuit means including single pulse generating means for energizing said driving coil means and a foot switch including a base sequentially operable switch means mounted on said base, said switch means having a normal switch position and sequentially operable advancing and driving switch positions for energizing first said advancing coil and thereafter said driving coil and an operating plate mounted on said base for sequentially operating said switch means said switch means only in said driving switch position operating to generate said single pulse and only in said normal switch position operating to reset said single pulse generating means.

15. In a stapler or the like as claimed in claim 14, wherein said single pulse generating means includes capacitor means and said switch means only in said driving switch position operates to discharge said capacitor means to generate said single pulse and only in said normal switch position operates to reset said single pulse generating means to charge said capacitor means.

16. In a stapler or the like having a driving head pivotally mounted on a support member for movement toward an anvil and an operating rod pivotally mounted on said driving head and extending therefrom adjacent said support member for moving said driving head, an electromagnetic power device for moving said operating rod comprising plunger means mounted on said support member for linear movement through an advancing stroke from a first inoperative position to a second position and through a driving stroke from said second position toward a third position said plunger means being coaxial with said operating rod and being adjustably connected thereto advancing coil means for moving said plunger means from said first position to said second position driving coil means for moving said plunger means from said second position toward said third position said advancing coil means being effective to move said plunger means through a greater stroke than said driving coil means and said driving coil means being effective to move said plunger with greater force than said advancing coil means and circuit means including single pulse generating means having capacitor means for energizing said driving coil means and a foot switch including a base sequentially operable switch means mounted on said base, said switch means having a normal switch position and sequentially operable advancing and driving switch positions for energizing first said advancing coil and thereafter said driving coil an operating plate mounted on said base for sequentially operating said switch means and spring means interposed between said base and said operating plate effective to provide greater opposing force to movement of said plate to said driving switch position than to movement of said plate to said advancing switch position said switch means only in said driving switch position operating to discharge said capacitor means to generate said single pulse and only in said normal switch position operating to reset said single pulse generating means to charge said capacitor means.

* * * * *